US007021969B2

(12) United States Patent
Matsunaga

(10) Patent No.: US 7,021,969 B2
(45) Date of Patent: Apr. 4, 2006

(54) CONNECTOR ALLOWING REDUCTION IN THICKNESS OF AN APPARATUS TO WHICH THE CONNECTOR IS TO BE MOUNTED

(75) Inventor: Akihiro Matsunaga, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 10/732,535

(22) Filed: Dec. 11, 2003

(65) Prior Publication Data

US 2004/0121653 A1 Jun. 24, 2004

(30) Foreign Application Priority Data

Dec. 12, 2002 (JP) ..... 2002-361234

(51) Int. Cl.
*H01R 24/00* (2006.01)

(52) U.S. Cl. ..... 439/630; 439/495; 439/631

(58) Field of Classification Search ..... 439/630–637, 439/67, 77, 495
See application file for complete search history.

(56) References Cited

U.S. PATENT DOCUMENTS

| | | | | |
|---|---|---|---|---|
| 3,366,919 | A * | 1/1968 | Gammel, Sr. et al. | 439/495 |
| 3,858,163 | A * | 12/1974 | Goodman et al. | 439/631 |
| 3,941,448 | A * | 3/1976 | Evans | 439/493 |
| 5,277,621 | A * | 1/1994 | Seto | 439/493 |
| 5,800,200 | A * | 9/1998 | Brioaud et al. | 439/404 |
| 5,928,027 | A * | 7/1999 | Kunishi | 439/495 |
| 5,951,315 | A | 9/1999 | Ichimura | |
| 6,062,887 | A * | 5/2000 | Schuster et al. | 439/218 |
| 6,101,372 | A * | 8/2000 | Kubo | 455/558 |
| 6,149,466 | A * | 11/2000 | Bricaud et al. | 439/630 |
| 6,231,394 | B1 | 5/2001 | Schnell et al. | |
| 6,234,810 | B1 | 5/2001 | Schnell et al. | |
| 6,250,966 | B1 * | 6/2001 | Hashimoto et al. | 439/631 |

FOREIGN PATENT DOCUMENTS

| | | |
|---|---|---|
| EP | 1030260 | 8/2000 |
| JP | 08055662 | 2/1996 |
| JP | 200036349 | 2/2000 |
| JP | 2000260537 | 9/2000 |
| JP | 2002117945 | 4/2002 |
| JP | 2002270261 | 9/2002 |

* cited by examiner

*Primary Examiner*—Hien Vu
(74) *Attorney, Agent, or Firm*—Baker Botts L.L.P.

(57) ABSTRACT

An insulator has a base surface extending along a flat plane, a first insert portion defined by the base surface and adapted to receive a first connection object therein in a first direction parallel to the base surface, and a second insert portion placed parallel to the first insert portion on the flat plane and adapted to receive a second connection object therein in a second direction which is parallel to the base surface and different from the first direction. The conductive member has a first contacting portion disposed over the base surface and adapted to be brought into contact with the first connection object in a third direction perpendicular to the flat plane, a second contacting portion disposed in the second insert portion and adapted to be brought into contact with the second connection object in the third direction, and a base plate portion connected to the first and the second contacting portions and fixedly held by the insulator.

16 Claims, 9 Drawing Sheets

CONNECTOR ALLOWING REDUCTION IN THICKNESS OF AN APPARATUS TO WHICH THE CONNECTOR IS TO BE MOUNTED

This application claims priority to prior Japanese application JP 2002-361234, the disclosure of which is incorporated herein by reference.

BACKGROUND OF THE INVENTION

This invention relates to a connector adapted to be mounted to an electronic or electric apparatus, such as a mobile telephone or a mobile terminal.

Recently, a small-sized external memory device such as a SIM (Subscriber Identity Module) card, a MMC (MultiMedia Card), a SD (Secure Digital) card, and a memory stick is known and increasingly used. The external memory device of the type may be used with an electronic or electric apparatus, such as a mobile telephone and a mobile terminal, as a module for identification of a subscriber. Upon use, the external memory device is connected to the apparatus through a connector which is mounted to the electronic or electric apparatus together with various parts, such as electronic parts.

The connector of the type is disclosed, for example, in JP 2000-260537 A (corresp. to U.S. Pat. No. 6,234,810 B1) and JP 2000-36349A (corresp. to U.S. Pat. No. 6,231,394 B1). However, the connector disclosed in each of these publications is relatively large as compared with the electronic parts mounted to the electronic or electric apparatus and therefore inhibits the reduction in thickness of the electronic or electric apparatus.

SUMMARY OF THE INVENTION

It is therefore an object of the present invention to provide a connector which allows the reduction in thickness of an apparatus to which the connector is to be mounted.

Other objects of the present invention will become clear as the description proceeds.

According to an aspect of the present invention, there is provided a connector for connecting a first connection object of a flat shape to a second connection object of a flat shape. The connector comprises an insulator and a conductive member coupled to the insulator. The insulator includes a base surface extending along a flat plane, a first insert portion defined by the base surface and adapted to receive the first connection object therein in a first direction parallel to the base surface, and a second insert portion placed parallel to the first insert portion on the flat plane and adapted to receive the second connection object therein in a second direction which is parallel to the base surface and different from the first direction. The conductive member includes a first contacting portion disposed over the base surface and adapted to be brought into contact with the first connection object in a third direction perpendicular to the flat plane, a second contacting portion disposed in the second insert portion and adapted to be brought into contact with the second connection object in the third direction, and a base plate portion connected to the first and the second contacting portions and fixedly held by the insulator.

According to another aspect of the present invention, there is provided a connector comprising a plurality of conductive first contacts to be connected to a first connection object having a flat shape and inserted in a first direction, a plurality of conductive second contacts to be connected to a second connection object having a flat shape and inserted in a second direction different from the first direction, the conductive second contacts being connected to the conductive first contacts, respectively, and an insulator holding the first and the second contacts, wherein each of the first contacts has a first contacting portion to be brought into elastic contact with a first mating contacting portion of the first connection object, each of the second contacts having a second contacting portion to be brought into elastic contact with a second mating contacting portion of the second connection object, the insulator having a first insert portion in which the first contacting portions are disposed so as to be brought into contact with the first mating contacting portions when the first connection object is inserted, and a second insert portion in which the second contacting portions are disposed so as to be brought into contact with the second mating contacting portions when the second connection object is inserted, the first insert portion having a base surface to face one surface of the first connection object provided with the first mating contacting portions when the first connection object is inserted, the first direction along which the first connection object is inserted being parallel to the base surface, the second direction along which the second connection object is inserted being parallel to the base surface, the second insert portion being formed at a position different from that of the first insert portion, the first and the second contacting portions being elastically displaceable in a third direction perpendicular to the base surface, the first and the second contacts being formed to be integral with each other.

According to still another aspect of the present invention, there is provided a mobile apparatus equipped with any one of the above-mentioned connectors.

DESCRIPTION OF THE PREFERRED EMBODIMENTS

Figure 1:
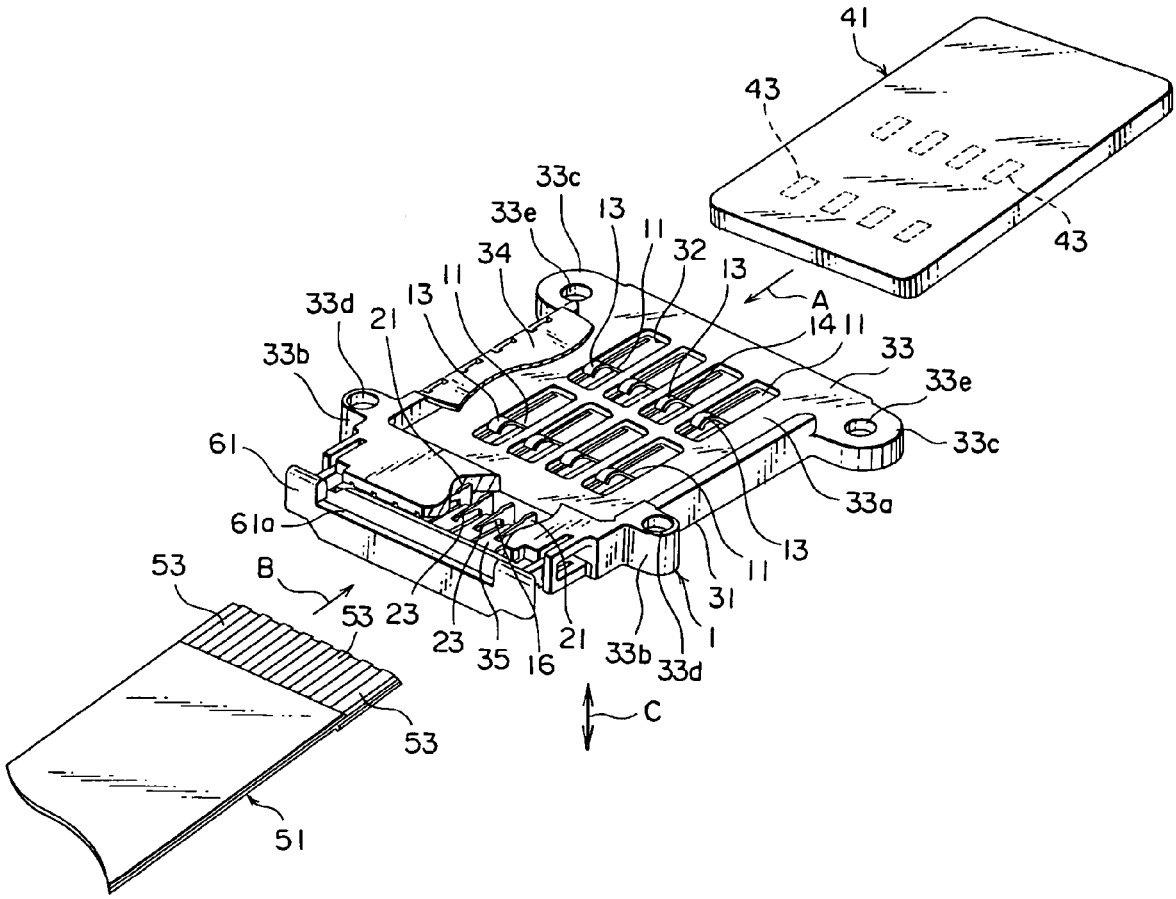
FIG. 1 is a partially cut-away perspective view of a connector according to one embodiment of this invention together with first and second connection objects.

Referring to FIGS. 1 through 7, description will be made as regards a connector according to one embodiment of this invention.

The connector 1 illustrated in the figure is mounted to an apparatus, such as a mobile telephone and a mobile terminal and serves to connect a first connection object 41 of a flat shape, such as a SIM card, a MMC, a SD card, and a memory stick, to a second connection object 51 of a flat shape, such as a FPC (Flexible Printed Circuit) and a FFC (Flexible Flat Cable). The first connection object 41 has a plurality of first mating contacting portions 43 disposed on one surface thereof and arranged in two rows. The second connection object 51 has a plurality of second mating contacting portions 53 disposed at one end thereof and arranged in a single row. In the manner which will be described below, the connector 1 comprises plural or eight conductive members 10 and an insulator 31 coupling or holding the conductive members 10.

The insulator 31 has a base surface 33*a* extending along a flat plane, a first insert portion 33 defined by the base surface 33*a* and adapted to receive the first connection object 41 therein in a first direction A parallel to the base surface 33*a*, and a second insert portion 35 adapted to receive the second connection object 51 therein in a second direction B which is parallel to the base surface 33*a* and different from the first direction A. The first and the second insert portions 33 and 35 are formed at opposite sides of the insulator 31 to be placed parallel to each other.

The base surface 33*a* is provided with a plurality of contact holes 32 so as to expose the first contacts 11 on the base surface 33*a*. To the insulator 31, a cover member 34 faced to and spaced from the base surface 33*a* is fixed. The gap between the base surface 33*a* and the cover member 34 is equal to or slightly greater than the thickness of the first connection object 41.

Figure 8A:
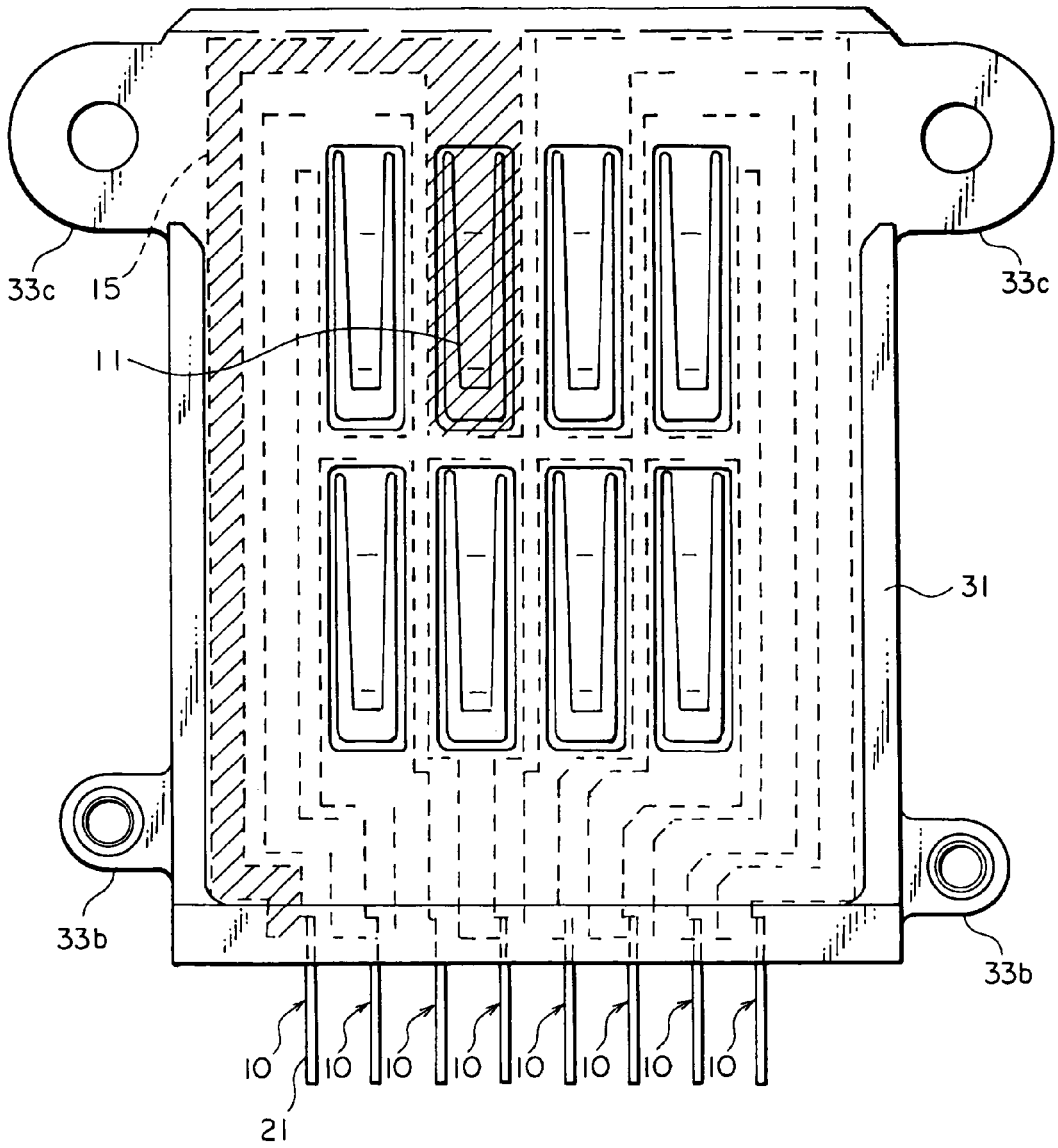
FIG. 8A schematically showing a position relation between an insulator and conductive members included in a connector modified from the connector of FIGS. 2–7.
Figure 8B:
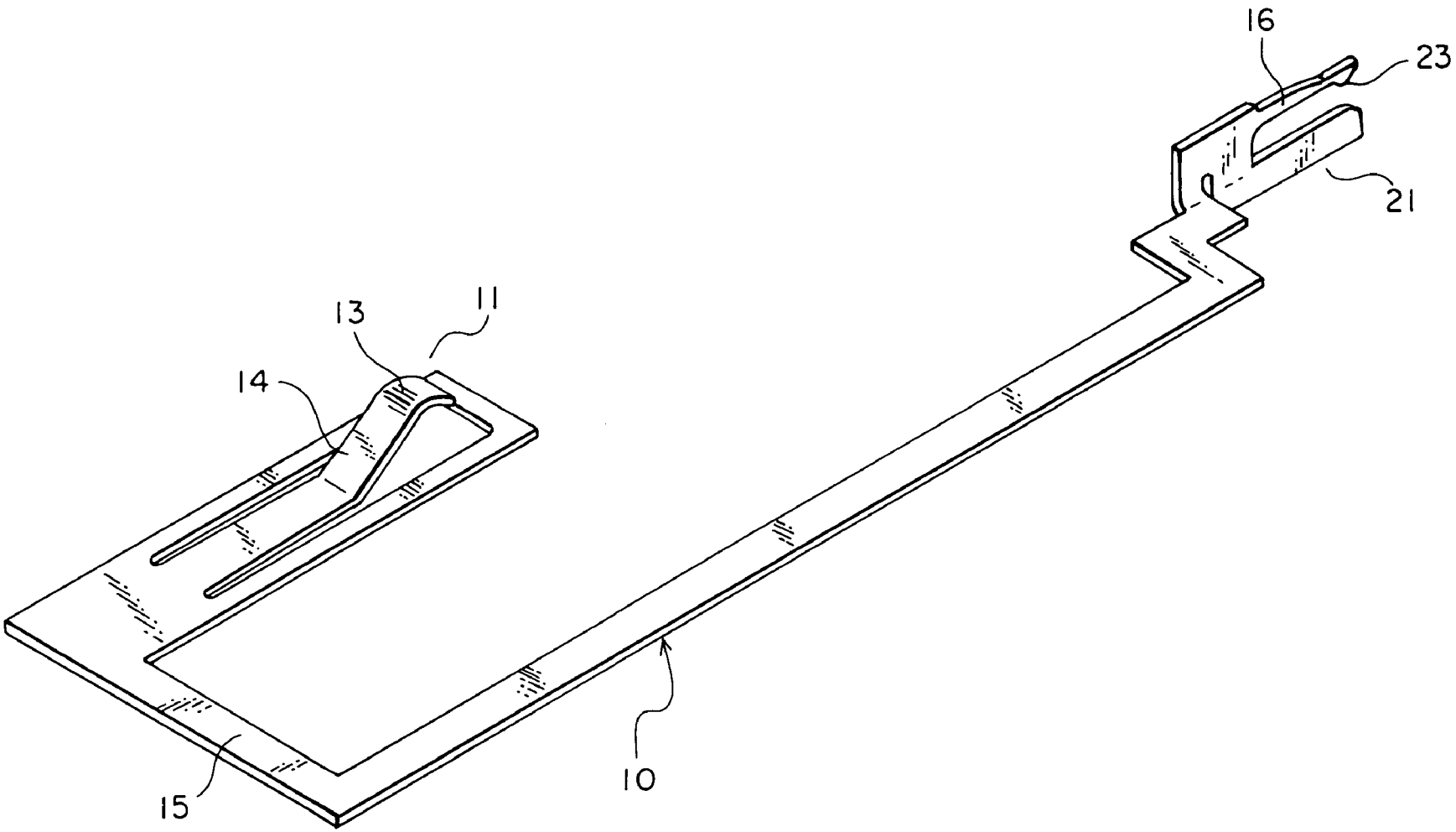
FIG. 8B is an enlarged perspective view of a hatched one of the conductive members used in the connector of in FIG. 8.

Referring to FIGS. 8A and 8B in addition, the description will be made about the conductive members 10. It should be noted here that FIG. 8B shows a hatched one of the conductive members 10 illustrated in FIG. 8A.

Each of the conductive members 10 is manufactured from a metal plate member and comprises a first contact 11, a second contact 21, and a base plate portion 15. The first and the second contact 11 and 21 are disposed at the first and the second insert portions 33 and 35, respectively. The base plate portion is of a flat shape and integrally couples the first and the second contacts 11 and 21 to each other.

In the conductive members 10 assembled to the insulator 31, the first contacts 11 are arranged in two rows while the second contacts 21 are arranged in a single row. The base plate portions 15 are fixed to the insulator 31.

The first contacts 11 are adapted to be connected to the first connection object 41. Each of the first contacts 11 includes a first contacting portion 13 to be brought into elastic contact with the first mating contacting portion 43 and a first spring portion 14 connected to the first contacting portion 13 and the base plate portion 15. The first spring portion 14 is elastically displaceable and serves to make the first contacting portion 13 be movable in a direction perpendicular to the base surface 33*a*.

The second contacts 21 are adapted to be connected to the second connection object 51. Each of the second contacts 21 includes a second contacting portion 23 to be brought into elastic contact with the second mating contacting portion 53 and a second spring portion 16 connected to the second contacting portion 23 and the base plate portion 15. The second spring portion 16 is elastically displaceable and serves to make the second contacting portion 23 be movable in a direction perpendicular to the base surface 33*a*.

Returning back to FIGS. 1–7, the description will be proceeded. When the first connection object 41 is inserted into the first insert portion 33 of the insulator 31 and received between the base surface 33*a* and the cover member 34, the first contacting portions 13 are brought into contact with the first mating contacting portions 43 with elastic deformation in a third direction C perpendicular to the base surface 33*a*. Upon insertion, the first connection object 41 is guided by the base surface 33*a* and the cover member 34. When the second connection object 51 is inserted into the second insert portion 35, the second contacting portions 23 are brought into contact with the second mating contacting portions 53 with elastic deformation in the third direction C.

The above-mentioned connector 1 will be described more in detail.

The first contacting portions 13 are arranged on the base surface 33*a* in two rows each of which includes four contacting portions 13. Thus, the first contacting portions 13 are equal in number to eight in total. The second contacting portions 23, eight in number, are aligned in a single row at an end of the insulator 31.

As illustrated in FIG. 8, the first and the second contacts 11 and 21 are integrally coupled with each other. The first and the second contacts 11 and 21 have terminal portions 11*c* and 21*c* to be connected to a conductive portion of a circuit board which will far later be described.

As illustrated in FIGS. 1, 2, 4, and 6, each of the first contacting portions 13 protrudes on the base surface 33*a* of the insulator 31 and bent substantially along an arc shape. The first mating contacting portions 43 are disposed on the first connection object 41 in an exposed state so as to face the first contacting portions 13 in one-to-one correspondence. The first mating contacting portions 43 are electrically connected to a memory or the like disposed inside the first connection object 41.

The second mating contacting portions 53 are disposed at the one end of the second connection object 51 in an exposed state so as to be connected to the second contacting portions 23 in one-to-one correspondence. The second connection object 51 has the other end connected to electronic parts or the like mounted inside the apparatus.

To the insulator 31, a slider 61 is coupled to be movable in the first and the second directions A and B. When the one end of the second connection object 51 is inserted into the second insert portion 35, the slider 61 serves to hold the second connection object 51 with the second mating contacting portions 53 brought into press contact with the second contacting portions 23.

When the slider 61 is pulled and moved in the first direction A and is separated from an end face of the insulator 31, the second insert portion 35 is opened wide. It is therefore easy to insert the second connection object 51 into the second insert portion 35. After the one end of the second connection object 51 is inserted into the second insert portion 35 to be brought into press contact with the second contacting portions 23, the slider 61 is pressed and pushed in the second direction B to be closely adjacent to or to be contacted with the end of the insulator 31. Then, the second mating contacting portions 53 are pressed by a pressing portion 61*a* of the slider 61 to be kept in press contact with the second contacting portions 23.

Figure 2:
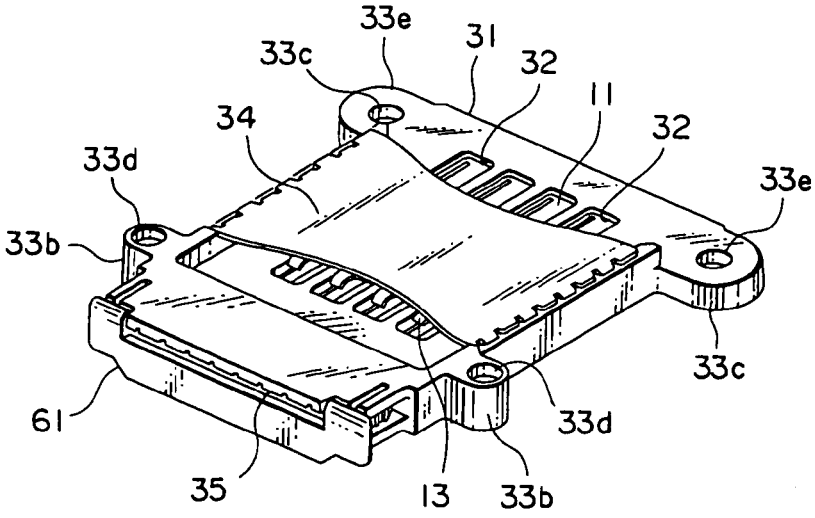
FIG. 2 is a perspective view of a whole shape of the connector illustrated in FIG. 1.
Figure 3:
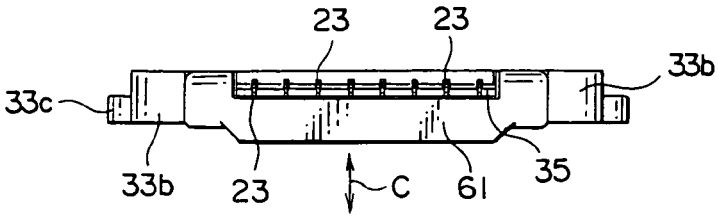
FIG. 3 is a front view of the connector illustrated in FIG. 2.
Figure 4:
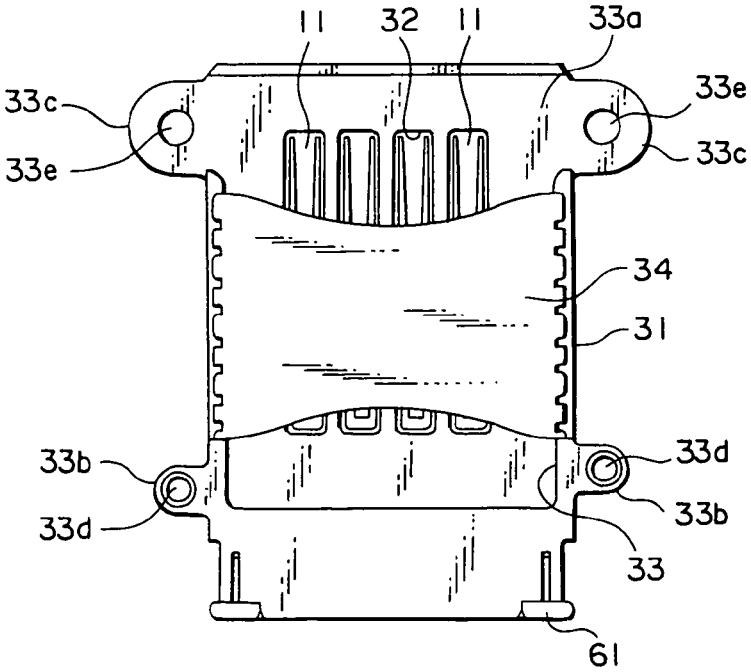
FIG. 4 is a plan view of the connector illustrated in FIG. 2.
Figure 5:
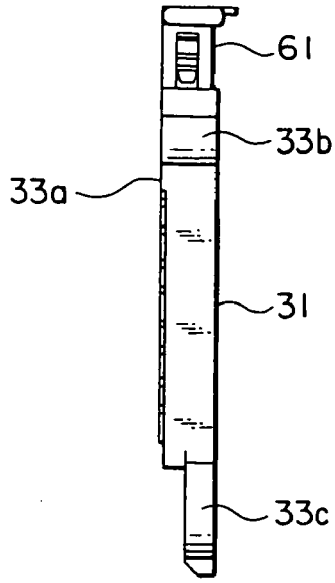
FIG. 5 is a right side view of the connector illustrated in FIG. 2.
Figure 6:
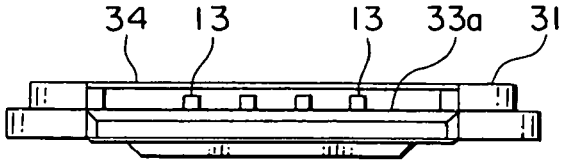
FIG. 6 is a rear view of the connector illustrated in FIG. 2.
Figure 7:
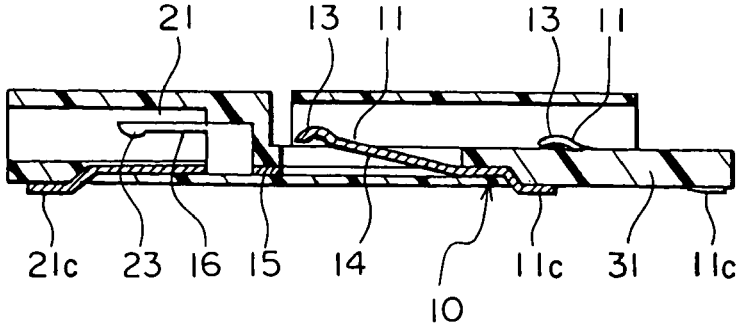
FIG. 7 is a sectional view of the connector illustrated in FIG. 2.

As illustrated in FIGS. 1, 2, and 4, the insulator 31 is of a generally rectangular shape in plan view and has a plate-shaped portion defined between the base surface 33*a* and an opposite surface opposite to the base surface 33*a*. The insulator 31 has fixing portions 33*b* and 33*c* formed in the vicinity of four corners of the plate-shaped portion, respectively. The fixing portions 33*b* and 33*c* are provided with fastening holes 33*d* and 33*e*, respectively. The fastening holes 33*d* and 33*e* receive fastening screws (not shown) which is for fastening the insulator 31 to a fixing object such as a circuit board which will become clear in the following description. Instead of the screws, pins may be inserted through the fastening holes 33*d* and 33*e*.

Figure 9:
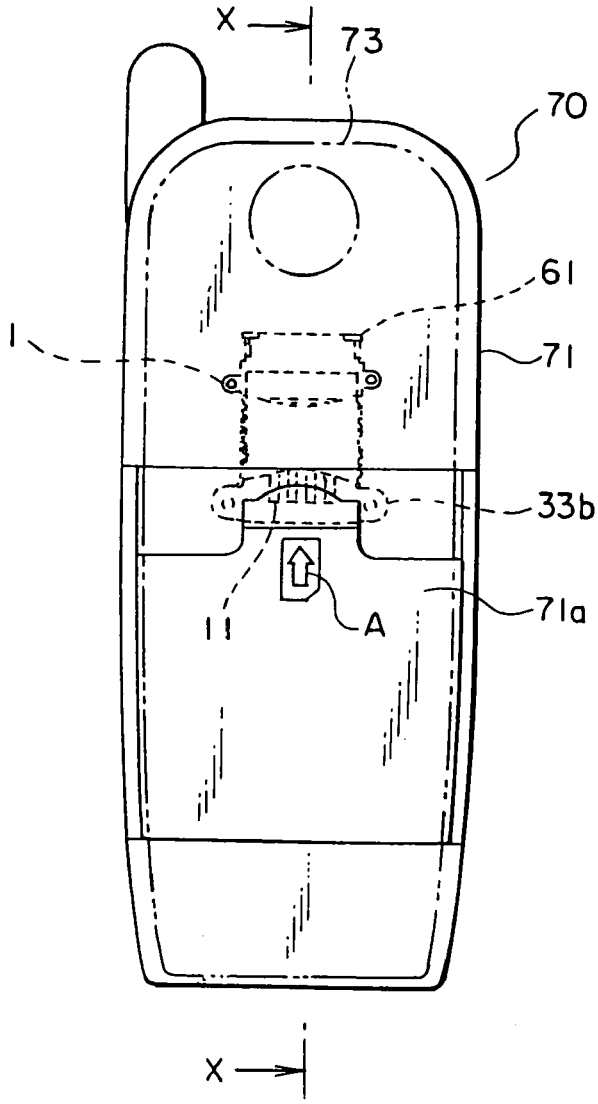
FIG. 9 is a plan view of an apparatus with the connector illustrated in FIGS. 1 through 7 mounted thereto.
Figure 10:
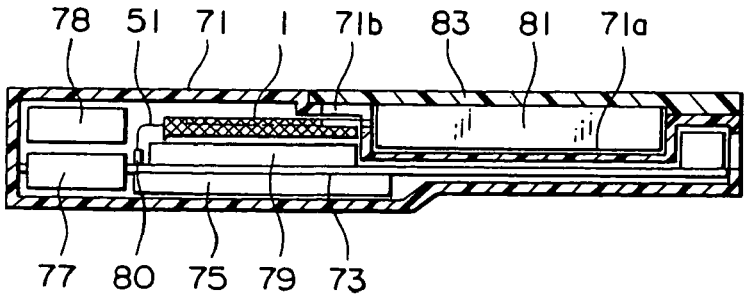
FIG. 10 is a sectional view taken along a line X—X in FIG. 9.

Referring to FIGS. 9 and 10, description will be made of an apparatus 70, such as a mobile telephone, with the above-mentioned connector 1 mounted thereto.

The apparatus 70 illustrated in the figure uses a SIM card as the first connection object 41. The apparatus 70 comprises a box-shaped casing 71, a main circuit board 73 disposed inside the casing 71, a liquid crystal display 75 disposed on the main circuit board 73 to be exposed on a front surface of the casing 71, parts 77 and 78, such as a loudspeaker, mounted within the casing 71, and an electronic part 79 mounted on a rear surface of the main circuit board 73 and positioned at a downstream side relative to the battery pack receiving portion 71*a* in the first direction A.

The casing 71 is provided with a battery pack receiving portion 71*a* formed inside a rear surface thereof. In the battery pack receiving portion 71*a*, a battery pack 81 is removably received. The casing 71 is provided with a cover 83 to allow the battery pack 81 to be inserted and removed from a rear side of the casing 71.

In the casing 71, the connector 1 is mounted and fixed to the main circuit board 73 by the use of the fastening holes 33*d* and 33*e*. The connector 1 is disposed to face the electronic part 79 and to be adjacent to the battery pack receiving portion 71*a*. Namely, the connector 1 is placed at a downstream side relative to the battery pack receiving portion 71*a* in the first direction A.

The battery pack receiving portion 71*a* is provided with a cut-out portion 71*b* formed on a wall portion of the casing 71 on the side towards the first direction A. The first connection object 41 is inserted through the cut-out portion 71*b* into the first insert portion 33 of the connector 1 with movement in the first direction A. Thus, the first mating contacting portions 43 of the first connection object 41 are brought into contact with the first contacting portions 13 of the first contacts 11.

The second connection object 53 serves to connect the main circuit board 73 and the second contacting portions 23. Specifically, the one end of the second connection object 53 is connected to the second contacting portions 23 and the other end of the second connection object 53 is connected to an additional connector 80 mounted to the main circuit board 73.

Next referring to FIGS. 11 through 14, description will be made of an operation of removing the first connection object 41 mounted to the apparatus 70.

Figure 11:
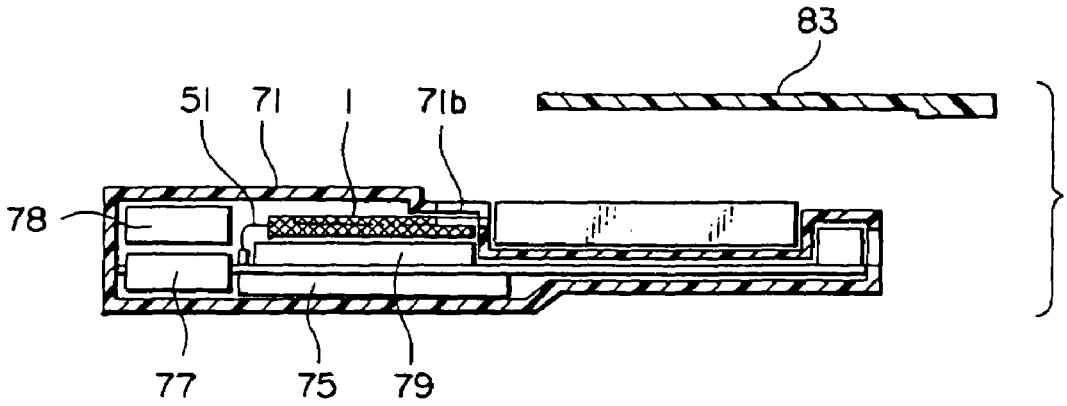
FIGS. 11 through 14 are sectional views similar to FIG. 10, for describing an operation of removing the first connection object from the apparatus illustrated in FIG. 9.
Figure 12:
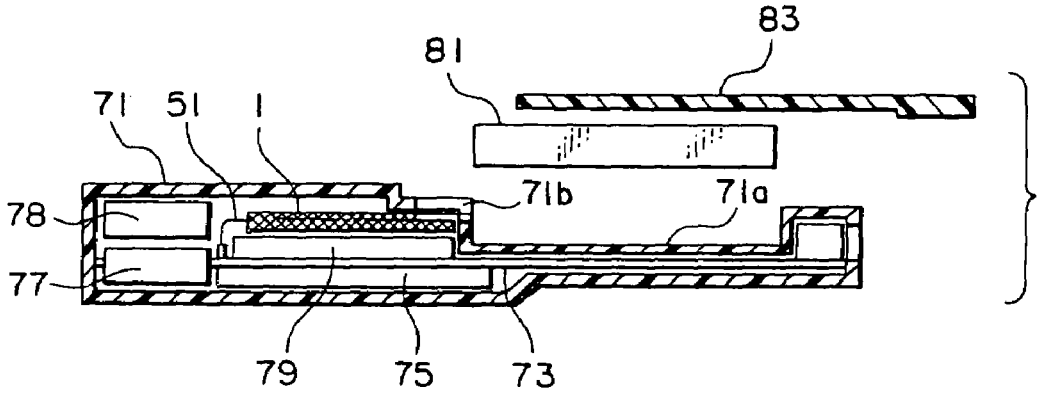
Figure 13:
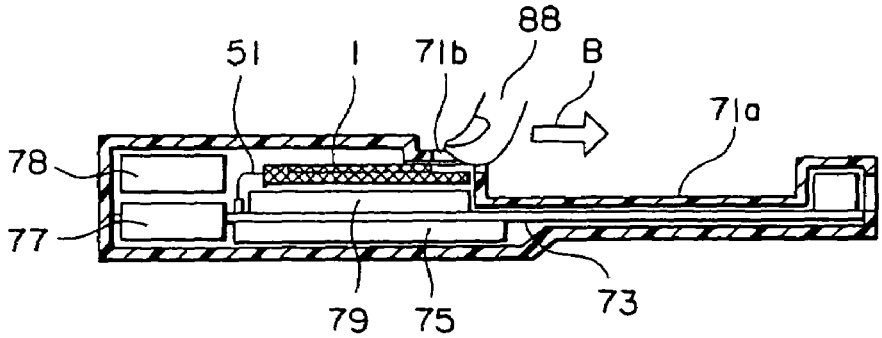
Figure 14:
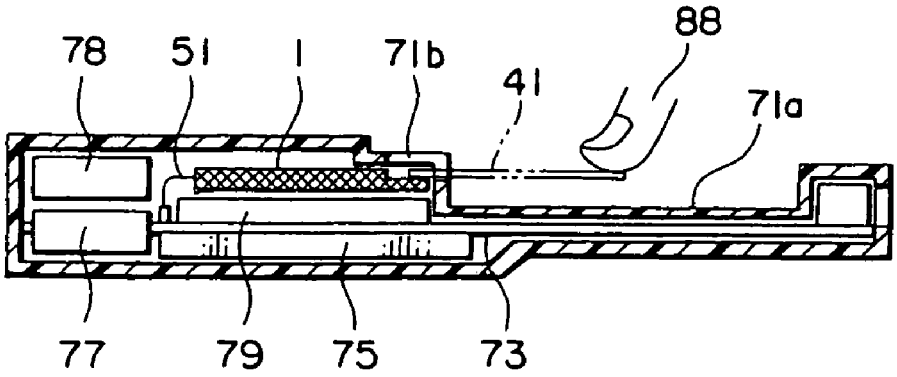

At first, as illustrated in FIG. 11, the cover 83 is removed from the casing 71 of the apparatus 70. Next, as illustrated in FIG. 12, the battery pack 81 is removed from the battery pack receiving portion 71*a*. Then, as illustrated in FIGS. 13 and 14, a user or an operator puts his finger 88 on a part of the first connection object 41 exposed on the side of the cut-out portion 71*b* of the casing 71 and pulls out the first connection object 41 in the second direction B.

In order to insert the first connection object 41 into the connector 1, an operation is carried out in the manner reverse to the above-mentioned operation of removing the first connection object 41.

Figure 15:
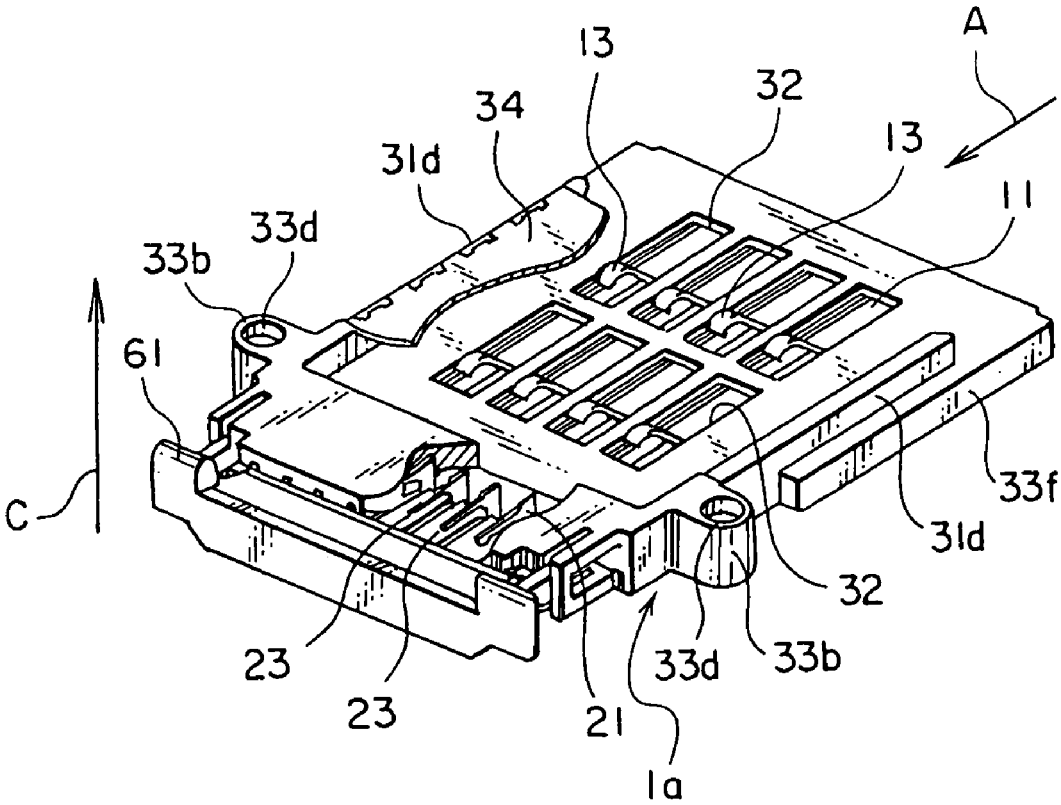
FIG. 15 is a perspective view of a modification of the connector illustrated in FIGS. 1 through 7.

Referring to FIG. 15, a modification of the connector will be described. Similar parts as those of the connector 1 illustrated in FIG. 1 are designated by like reference numerals and description thereof will be omitted.

In a connector 1*a* illustrated in FIG. 15, the insulator 31 has a pair of outer side surfaces 31*d* extending in parallel to the first and the second directions A and B and a pair of positioning arms 33*f* formed on the outer side surfaces 31*d*, respectively. Each of the positioning arms 33*f* is formed at a relatively upstream part of the insulator 31 in the first direction A. The connector 1*a* is incorporated into the casing 71 illustrated in FIG. 9 in the third direction C and properly positioned by the use of the positioning arms 33*f*.

On the outer side surfaces 31*d* of the insulator 31 at the end towards the first direction A, the fixing portions 33*b* are formed in the vicinity of the two corners, respectively, like in the insulator 31 illustrated in FIG. 1. The fixing portions 33*b* are provided with the fastening holes 33*d*, respectively. The screws are inserted through the fastening holes 33*d* to fix the insulator 31 to the main circuit board 73.

Figure 16:
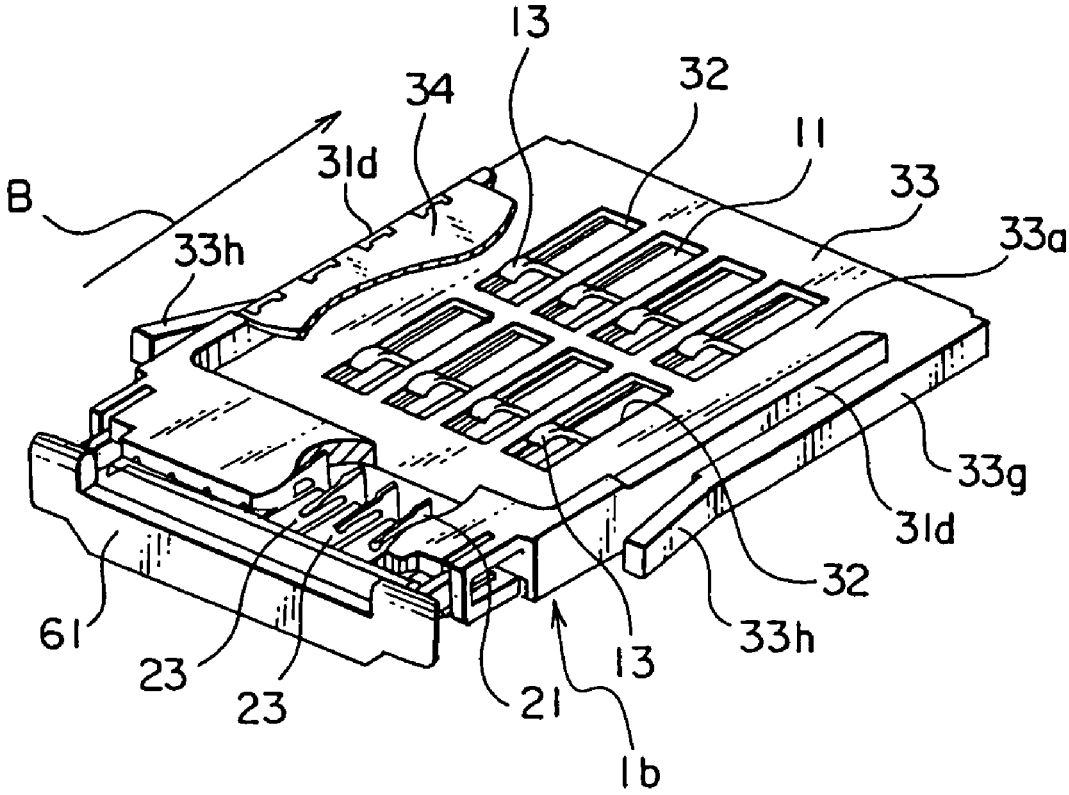
FIG. 16 is a perspective view of another modification of the connector illustrated in FIGS. 1 through 7.

Referring to FIG. 16, another modification of the connector will be described. Similar parts as those of the connector 1*a* illustrated in FIG. 15 are designated by like reference numerals and description thereof will be omitted.

In the connector 1*b* illustrated in FIG. 16, the insulator 31 is provided with a pair of positioning arms 33*g* formed on the outer side surfaces 31*d* extending in parallel to the first and the second directions A and B. Each of the positioning arms 33*g* is formed at a relatively downstream part of the insulator 31 in the second direction B.

Each of the positioning arms 33*g* is provided with an elastic piece 33*h* extending away from the outer side surface 31*d*. The positioning arms 33*f* and the elastic pieces 33*h* are incorporated into the casing 71 illustrated in FIG. 9 in the third direction C.

While the present invention has thus far been described in connection with a few embodiments thereof, it will readily be possible for those skilled in the art to put this invention into practice in various other manners. For example, it is noted here that the first and the second directions need not be opposite to each other but may intersect each other at any appropriate angle. The fastening holes may be formed at one or more positions. The conductive members may be equal in number to nine or more and to seven or less.

What is claimed is:

1. A connector for connecting a first connection object of a flat shape to a second connection object of a flat shape, the connector comprising:

an insulator; and a conductive member coupled to the insulator, said insulator comprising:

a base surface extending along a flat plane;

a first insert portion defined by the base surface with first fixing portions comprising first fastening holes formed therethrough and to receive the first connection object therein in a first direction parallel to the base surface; and a second insert portion with second fixing portions comprising second fastening holes formed therethrough placed parallel and opposite to the first insert portion on the flat plane and to receive the second connection object therein in a second direction which is parallel to the base surface and different from the first direction, the conductive member comprising:

first contacting portions disposed over the base surface in first and second rows and to be brought into contact with the first connection object in a third direction perpendicular to the flat plane;

a second contacting portion disposed in the second insert portion and to be brought into contact with the second connection object in the third direction; and a base plate portion connected to the first and the second contacting portions and fixedly held by the insulator; wherein the insulator being mounted to a circuit board, the first and second contacting portions further comprising terminal portions to be connected to the circuit board.

2. The connector according to claim 1, wherein the conductive member further comprising:

a first spring portion connected between the first contacting portion and the base plate portion to make the first contacting portion be elastically movable in the third direction; and a second spring portion connected between the second contacting portion and the base plate portion to make the second contacting portion be elastically movable in the third direction.

3. The connector according to claim 1, wherein the insulator has a plate-shaped portion which is defined by the base surface and an opposite surface opposite to the base surface, the first insert portion being located at the plate-shaped portion.

4. The connector according to claim 3, wherein the second insert portion is placed adjacent to the first insert portion on the flat plane.

5. The connector according to claim 3, wherein the plate-shaped portion is used for fixing the connector to a fixing object.

6. The connector according to claim 1, wherein the insulator is provided with a cover member which is cooperated with the base surface and is for defining the first insert portion therebetween.

7. The connector according to claim 1, further comprising a slider coupled to the insulator and movable in the second direction for holding the second connection object to make the second connection object be brought into press contact with the second contacting portion.

8. A connector comprising:

a plurality of conductive first contacts arranged in first and second rows to be connected to a first connection object having a flat shape and inserted in a first direction;

a plurality of conductive second contacts to be connected to a second connection object having a flat shape and inserted in a second direction different from the first direction, the conductive second contacts being connected to the conductive first contacts, respectively; and an insulator holding the first and the second contacts, wherein each of the first contacts has a first contacting portion to be brought into elastic contact with a first mating contacting portion of the first connection object, each of the second contacts having a second contacting portion to be brought into elastic contact with a second mating contacting portion of the second connection object, the insulator having a first insert portion with first fixing portions comprising first fastening holes formed therethrough, in which the first contacting portions are disposed so as to be brought into contact with the first mating contacting portions when the first connection object is inserted, and a second insert portion with second fixing portions comprising second fastening holes formed therethrough, in which the second contacting portions are disposed so as to be brought into contact with the second mating contacting portions when the second connection object is inserted, the first insert portion having a base surface to face one surface of the first connection object provided with the first mating contacting portions when the first connection object is inserted, the first direction along which the first connection object is inserted being parallel to the base surface, the second direction along which the second connection object is inserted parallel to the base surface and opposite to the first insert portion, the second insert portion being formed at a position different from that of the first insert portion, the first and the second contacting portions being elastically displaceable in a third direction perpendicular to the base surface, the first and the second contacts being formed to be integral with each other; wherein the insulator being mounted to a circuit board, the first and second contacting portions further comprising terminal portions to be connected to the circuit board.

9. A mobile apparatus comprising the connector according to claim 1.

10. A mobile apparatus comprising the connector according to claim 2.

11. A mobile apparatus comprising the connector according to claim 3.

12. A mobile apparatus comprising the connector according to claim 4.

13. A mobile apparatus comprising the connector according to claim 5.

14. A mobile apparatus comprising the connector according to claim 6.

15. A mobile apparatus comprising the connector according to claim 7.

16. A mobile apparatus comprising the connector according to claim 8.

* * * * *